United States Patent [19]

Richter et al.

[11] Patent Number: 4,924,933

[45] Date of Patent: May 15, 1990

[54] APPARATUS AND METHOD FOR INTRODUCING A DEVICE INTO A HEAT EXCHANGER

[75] Inventors: Bernd Richter, Uelzen; Ulrich Rittler, Kirchberg, both of Fed. Rep. of Germany

[73] Assignee: Siemens Aktiengesellschaft, Munich, Fed. Rep. of Germany

[21] Appl. No.: 245,365

[22] Filed: Sep. 16, 1988

[30] Foreign Application Priority Data

Sep. 18, 1987 [DE] Fed. Rep. of Germany ... 8712638[U]

[51] Int. Cl.[5] ..... F28G 13/00; F28G 15/00; G21C 17/00; B25J 19/00

[52] U.S. Cl. ..... 165/1; 165/11.2; 165/76; 901/1; 901/44

[58] Field of Search ..... 165/1, 11.2, 76; 901/1, 901/44

[56] References Cited

U.S. PATENT DOCUMENTS

| | | | |
|---|---|---|---|
| 4,212,583 | 7/1980 | Gebelin | 165/76 |
| 4,373,855 | 2/1983 | Lebouc | 165/76 |
| 4,508,063 | 4/1985 | Monne | 165/76 |
| 4,638,667 | 1/1987 | Zimmer et al. | 165/11.1 |
| 4,804,038 | 2/1989 | Klahn et al. | 165/11.2 |

*Primary Examiner*—John Ford

*Attorney, Agent, or Firm*—Herbert L. Lerner; Laurence A. Greenberg

[57] ABSTRACT

An apparatus for introducing and/or positioning a device in a chamber of a heat exchanger includes an assembly yoke with ends and a middle. The yoke may manually be introduced into the chamber of the heat exchanger with a pole. At least three remotely-actuatable clamping fingers are disposed on the assembly yoke. The clamping fingers are designed such that they may be locked or braced in tubes of the heat exchanger. For this purpose, respective locking devices that are remotely controllable may be used. A lifting cylinder holds one of the clamping fingers at least approximately at the middle of the yoke. Remotely-actuatable clamping devices each hold at least one of the clamping fingers on a respective one of the ends of the yoke. Toothed belts each have an end connected to a respective one of the clamping fingers positioned on the ends of the yoke. Two synchronously controllable elevators each have a toothed belt drive in engagement with a respective one of the toothed belts. Support elements and releasable connectors for the device to be introduced and/or positioned are disposed on the synchronously controllable elevators.

14 Claims, 3 Drawing Sheets

APPARATUS AND METHOD FOR INTRODUCING A DEVICE INTO A HEAT EXCHANGER

This invention relates to an apparatus and a method for introducing and/or positioning a device, in particular a manipulator, in a chamber of a heat exchanger.

German Patent DE-PS 28 30 306 discloses a testing device for the tubes of a heat exchanger. The testing device is associated with an apparatus for introduction into a chamber of the heat exchanger which is accessible through a manhole. This apparatus includes a rail with a carriage movable thereon, so that testing and repair devices in the form of sensors, which are introduced by means of a hose, can be brought to the tube sheet of the heat exchanger. In that prior art device, a flange screwed to the manhole is used for fastening the rail. The end of the rail protruding into the chamber of the heat exchanger is fixed on the tube sheet by means of at least one centering mandrel. The rail leading into the chamber and the retaining means thereof narrow the inside width of the manhole, so that larger equipment can only be introduced with very great difficulty.

It is accordingly an object of the invention to provide an apparatus and a method for introducing and/or positioning a device in the chamber of a heat exchanger, which overcome the hereinafore-mentioned disadvantages of the heretofore-known devices of this general type and with which the device, in particular a manipulator, can be introduced simply and quickly without notably restricting the free opening of the manhole.

With the foregoing and other objects in view there is provided, in accordance with the invention, an apparatus for introducing and/or positioning a device, in particular a manipulator, in a chamber of a heat exchanger, comprising an assembly yoke with ends and a middle to be manually introduced into a chamber of the heat exchanger, e.g. with a pole, at least three remotely-actuatable clamping fingers disposed on the assembly yoke, means for locking the clamping fingers in tubes of the heat exchanger, a lifting cylinder holding one of the clamping fingers at least approximately at the middle of the yoke, remotely-actuatable clamping devices each releasably holding at least one of the clamping fingers on a respective one of the ends of the yoke, toothed belts each having an end connected to a respective one of the clamping fingers on the ends of the yoke, two synchronously controllable elevators each having a toothed belt drive in engagement with a respective one of the toothed belts, and support elements and releasable connecting means for the device, said support elements and releasable connecting means being disposed on the synchronously controllable elevators. Preferably, each clamping finger has associated therewith an individual bracing or locking device.

In the apparatus according to the invention, the operator only needs to introduce a relatively lightweight yoke through the manhole into the chamber from the outside, e.g. by using a pole, without entering the chamber, then to move it to the tube sheet and, without looking into the chamber, to introduce the central clamping finger into a desired heat exchanger tube and to clamp, brace or lock it by remote control.

In accordance with another feature of the invention, there is provided a terminal contact disposed on the yoke or on at least one of the clamping fingers for triggering an automatic bracing of the at least one clamping finger after the at least one clamping finger has been introduced into a heat exchanger tube to a predetermined extent, e.g. once the terminal contact is in contact with the tube sheet. This considerably facilitates and speeds up the attachment of the yoke.

In accordance with a further feature of the invention, the lifting cylinder is rotatably supported on the yoke with the clamping finger at the middle of the yoke. This makes it possible to put the yoke into a desired position at the tube sheet, e.g. by using the pole, prior to bracing the clamping fingers disposed at the ends. The clamping fingers disposed at the ends of the yoke can then each be introduced into a chosen respective heat exchanger tube by actuation of the lifting cylinder, and the outer fingers may subsequently be braced therein by means of the associated locking devices.

In accordance with an added feature of the invention, there is provided a piston rod of the lifting cylinder, gearing connected to the piston rod, and a remote-controllable electric drive motor connected to the gearing. This permits the alignment of the yoke to be advantageously carried out under remote control instead of using the pole.

After the clamping fingers provided with the toothed belts have been braced in the heat exchanger tubes, the yoke may be detached by loosening the clamping devices of the braced clamping fingers located at the yoke ends and by loosening or unlocking the locking device of the central clamping finger, and the yoke can be removed, e.g. with the pole, so that only the two clamping fingers located at the yoke ends and having attached thereto the toothed belts remain braced in the heat exchanger tubes. At these toothed belts, the device to be introduced is then driven into the chamber with the aid of the toothed belt drive. The device is subsequently braced in the heat exchanger tubes by means of additional clamping fingers (having additional locking devices) disposed on the device. The clamping fingers associated with the toothed belts can now be removed from the tube sheet once the respective locking devices have been loosened or unlocked.

In accordance with a concomitant feature of the invention, the pole to be used has an end with a remotely-actuatable gripper device, which is in particular actuatable by means of pressure fluid.

In accordance with the invention, a method for introducing and/or positioning a device in a chamber of a heat exchanger comprises the steps of:

(a) introducing an assembly yoke through the manhole into the chamber of the heat exchanger, the assembly yoke having a central clamping finger which is centrally disposed thereon and having at least two outer clamping fingers which are releasably disposed on respective ends thereof, said outer clamping fingers having connected thereto respective toothed belts;

(b) introducing the central clamping finger into a selected tube of the heat exchanger and locking the central clamping finger in the selected tube under remote control;

(c) rotating the assembly yoke about the central clamping finger, thereby adjusting a desired position with respect to the tube plate of the heat exchanger;

(d) moving the assembly yoke toward the tube plate of the heat exchanger, thereby introducing the outer clamping fingers into respective chosen tubes of the heat exchanger, and locking the outer clamping fingers in the respective chosen tubes under remote control;

(e) releasing the releasingly disposed outer clamping fingers from the assembly yoke, the outer clamping fingers still remaining in the chosen tubes, unlocking the central clamping finger in the selected tube, and subsequently removing the assembly yoke from the tube plate; and (f) moving the device along the threated belts into the chamber.

Other features which are considered as characteristic for the invention are set forth in the appended claims.

Although the invention is illustrated and described herein as embodied in an apparatus and a method for introducing a device into a heat exchanger, it is nevertheless not intended to be limited to the details shown and described, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
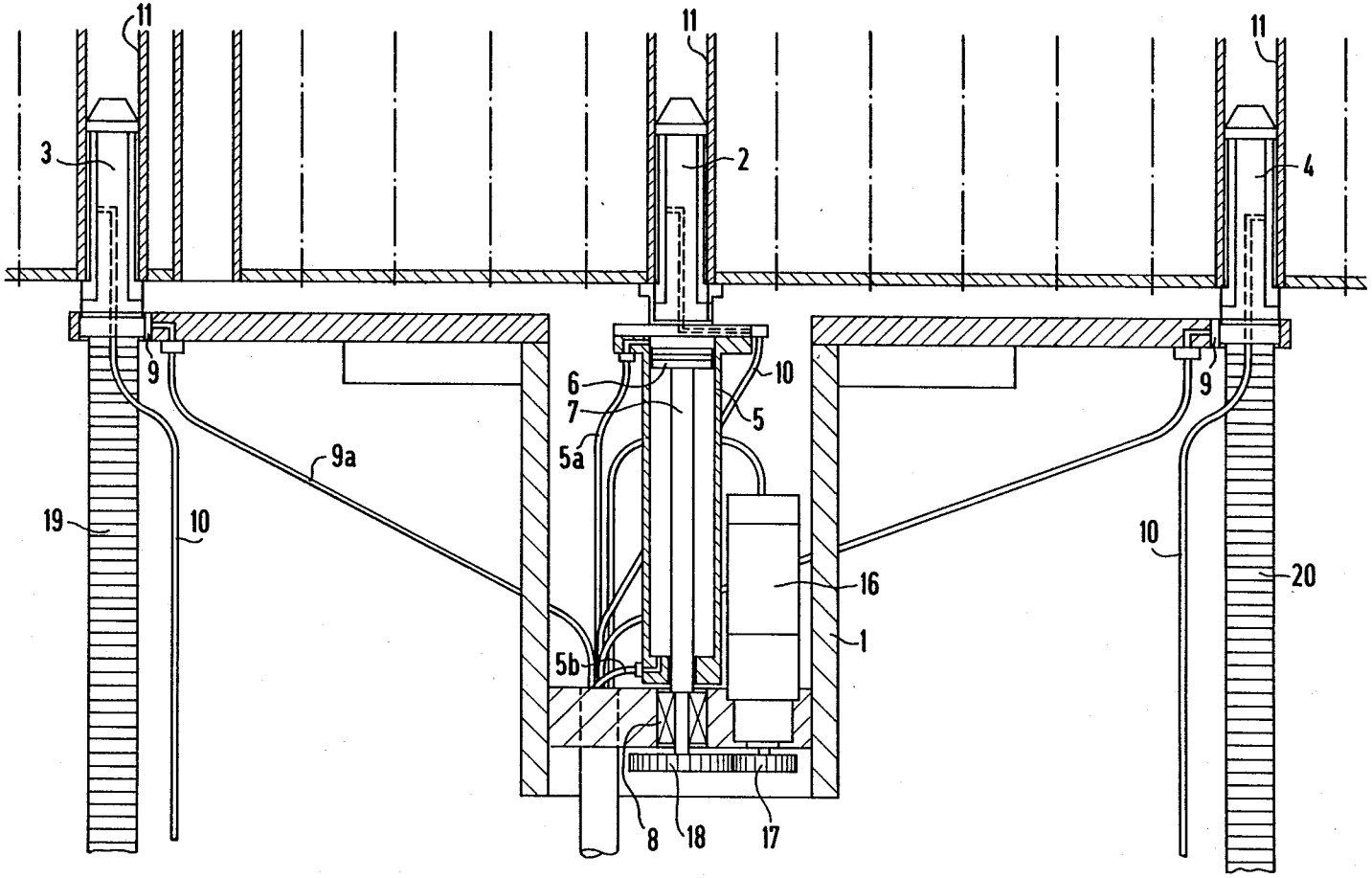
FIG. 1 is a fragmentary, diagrammatic, cross-sectional view of a yoke disposed on the tube sheet of a heat exchanger.

Referring now to the figures of the drawings in detail and first, particularly, to FIG. 1 thereof, there is seen a yoke 1 on which at least three remotely-actuatable clamping fingers, chucking fingers or toe dogs 2, 3, 4 are disposed for the introduction of a device, in particular a manipulator, into a chamber of a heat exchanger. The clamping finger 2 is provided centrally and at least approximately in the middle of the yoke 1. The central clamping finger 2 is rotatable due to the interposition of a lifting cylinder 5 having a piston 6 and a piston rod 7, and due to roller bearings 8 on the yoke 1. The lifting cylinder 5 is actuatable through pressure fluid lines 5*a*, 5*b*. At least one clamping finger 3, 4 is disposed at each respective end of the yoke 1, and in particular at least one pair of clamping fingers is provided at each end. The fingers 3, 4 are releasably retained at the yoke ends by remotely-actuatable clamping devices 9 to which pressure fluid lines 9*a* are connected.

The clamping fingers 2, 3, 4 each have a conventional spreader (not designated) which is actuated by pressure fluid delivered through pressure fluid lines 10 and enables clamping, bracing or locking of the spreading fingers 2, 3, 4 in heat exchanger tubes 11.

A toothed belt 19, 20 is suspended from each of the two clamping fingers 3, 4, respectively, or from each of the pairs of clamping fingers disposed at the ends of the yoke 1.

Figure 2:
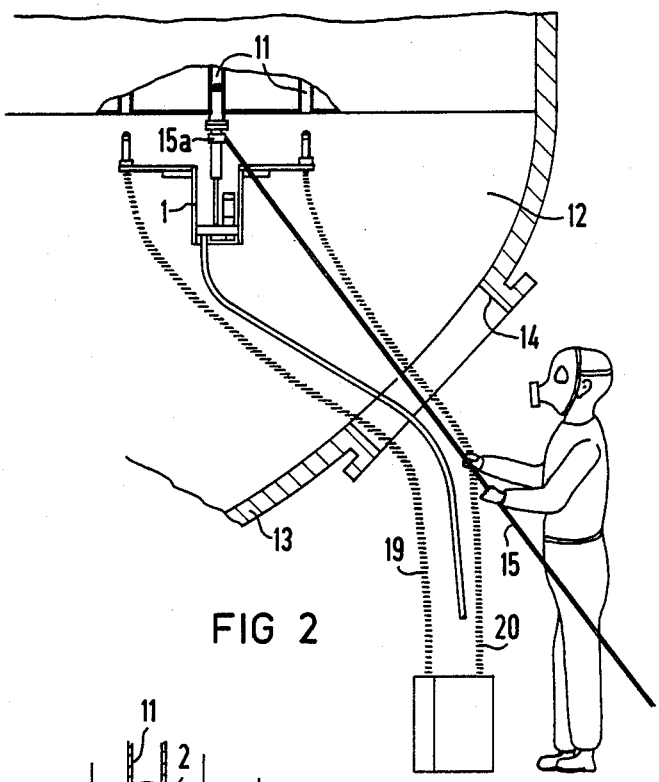
FIG. 2 is a fragmentary, partly broken-away cross-sectional view illustrating the introduction of the yoke into a chamber of a heat exchanger.

FIG. 2 shows a chamber of a heat exchanger 12, the top of which is defined by a tube sheet or tube plate into which the heat exchanger tubes 11 discharge. The underside of the chamber is closed off by a hemispherical bottom 13, in which a manhole 14 is provided. Devices and apparatus such as a manipulator, tools, testing equipment and the like can be introduced through the manhole 14. In the illustrated embodiment, in order to facilitate the introduction of a device or apparatus, especially a manipulator, the yoke 1 is first introduced (manually) through the manhole 14 by an operator using a pole 15, and the middle or central clamping finger 2 is introduced into an arbitrary heat exchanger tube 11 with the cylinder 5 extended. The pole 15 has a remotely-actuatable gripper device 15*a* on the free end thereof, in particular a device which is actuatable by means of pressure fluid. Upon actuation, the pole 15 firmly grasps a portion of the yoke 1, in particular the top of the cylinder 5, with the gripper device 15*a*.

Figure 3:
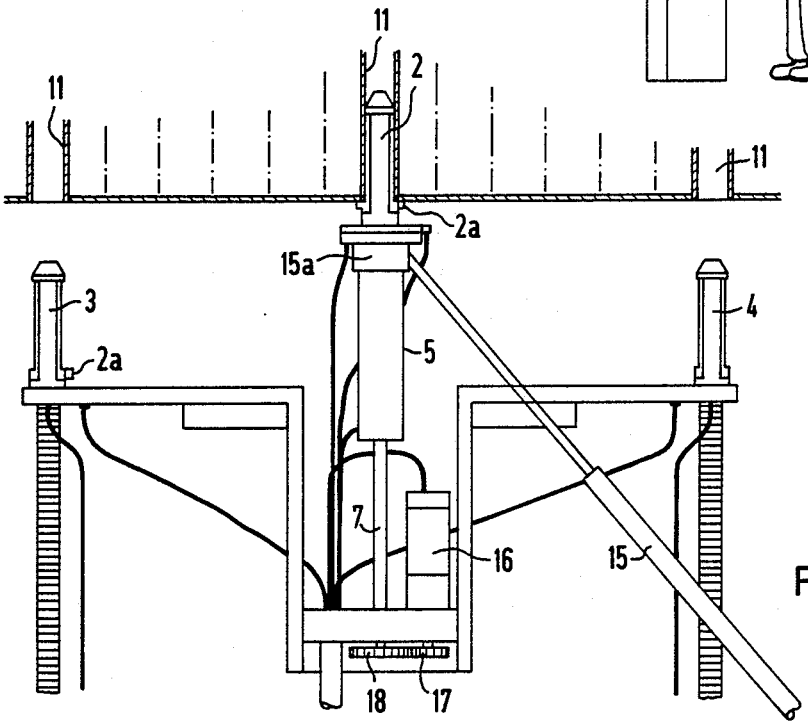
FIG. 3 is a view similar to a portion of FIG. 1 illustrating locking of the yoke with toothed belts disposed on outer clamping fingers.

After the introduction of the yoke 1, the spreader of the clamping finger 2 is actuated by remote control, so that it is braced in the arbitrarily chosen heat exchanger tube 11, as seen in FIG. 3.

A terminal contact 2*a* is provided on the control clamping finger 2. It trips an automatic bracing of the central clamping finger 2 whenever the terminal contact 2*a* comes into contact with the tube sheet after the central clamping finger 2 has been introduced into a heat exchanger tube 11.

The yoke 1 is then brought into a desired position with respect to the tube sheet. To this end, it is rotated about the central clamping finger 2 in the direction of the rows of tubes (that is in the direction of a line connecting the centers of the tubes in the X direction) or in other words parallel to the tube corridor, until the two outer clamping fingers 3, 4 or pairs of clamping fingers disposed on the ends of the supporting yoke 1 are located beneath two or four heating tube openings, respectively. This can be carried out by means of the pole 15, or alternately and advantageously through a remotely-controllable electric drive motor 16, which is connected through a gear in the form of a pinion 17 and gear wheel 18 to the piston rod 7 of the lifting cylinder 5. The clamping fingers 2, 3, 4 are mutually spaced apart by a distance that is an integral multiple of the distance between two heat exchanger tubes 11.

By raising the piston within the lifting cylinder 5, the outer clamping fingers 3, 4 are introduced into the heat exchanger tubes 11 and braced or locked therein by remote actuation. Similarly, for automatic bracing, terminal contacts 2*a* may be provided on the yoke 1 or on the outer clamping fingers 3, 4.

Figure 4:
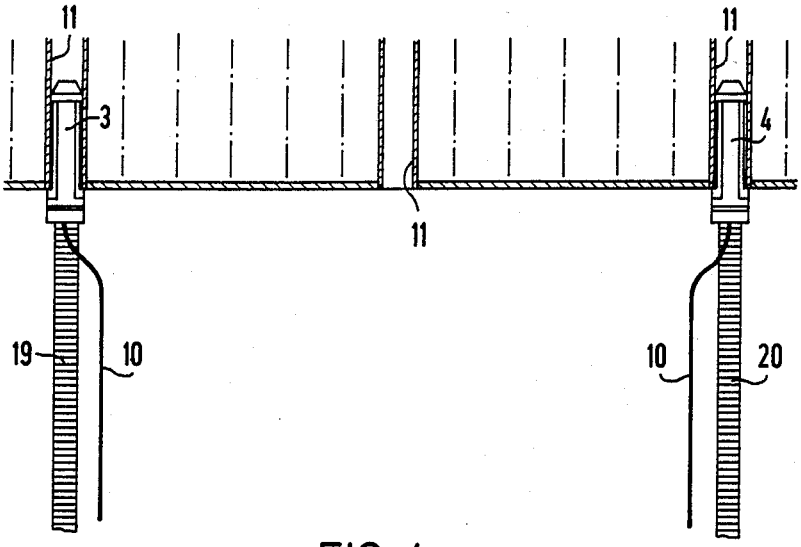
FIG. 4 is a view similar to a portion of FIG. 3 illustrating the toothed belts locked on the tube sheet through the clamping fingers after the removal of the yoke.

After bracing the outer clamping fingers 3, 4 or pairs of fingers in the heat exchanger tubes 11, the associated clamping devices 9 and the spreader of the central clamping finger 2 can be detached or untightened by remote control, and the supporting yoke 1 and finger 2 can be removed with the pole 15. As FIG. 4 shows, only the two clamping fingers 3, 4 with the toothed belts 19, 20 suspended from them then remain anchored in the tube sheet.

The spreaders of the clamping fingers 2, 3, 4 may be formed of rubber or metal.

Figure 5:
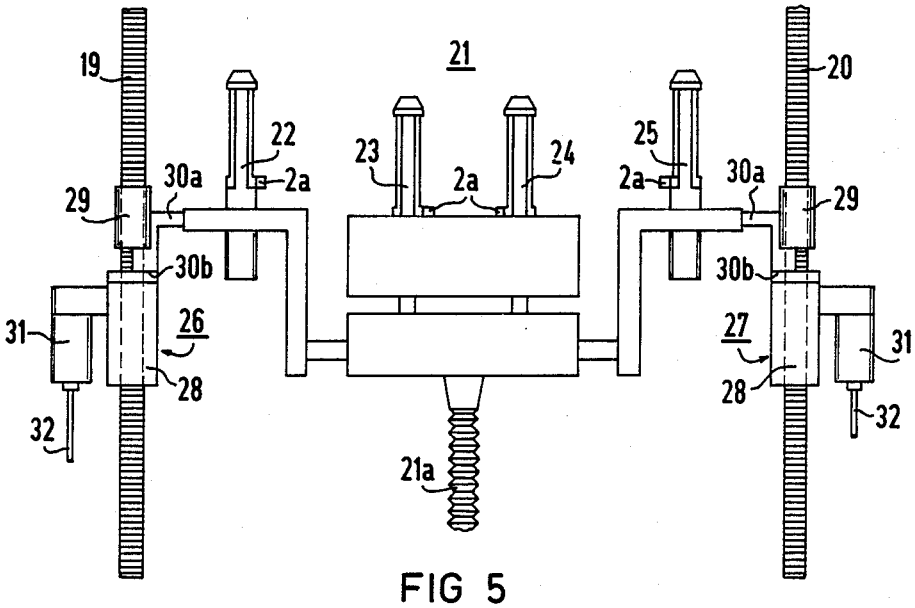
FIG. 5 is a fragmentary, side-elevational view illustrating the remote-controlled introduction of a device constructed as a manipulator, by means of two elevators engaging the toothed belts.

The device 21 to be introduced, which is constructed as a finger walker in FIG. 5, has a walking mechanism with a number of additional clamping fingers 22, 23, 24, 25 as well as supply and control lines, which are accommodated in a flexible tube 21*a*. The clamping fingers 22 through 25 are designed like the fingers 2, 3 and 4. The device 21 is detachably disposed on two elevators 26, 27, which are each equipped with a toothed belt drive 28 and are controllable synchronously. To the toothed belt drives 28 are assigned tubular guides 29. Support elements 30*a* and connecting means 30*b* for releasably holding the device 21 are disposed on the belt drives 28. The toothed belt drives 28 are connected in torque-locking fashion with synchronously controllable electric drive motors 31, which are connected to electric supply and control lines 32. The elevators 26, 27, which are constructed as electric lifting drives, carry the device 21 through the manhole 14 underneath the tube sheet, until the clamping fingers 22 and 25 connected to the device 21 protrude sufficiently far into the heat exchanger tubes 11 and can be braced therein. Terminal contacts 2*a* may again be provided on the clamping fingers 22 through 25 of the device 21, so as to trip an automatic bracing or locking of the clamping fingers 22 through 25 after introduction has been completed.

The elevators 26, 27 with the flexible toothed belts 19, 20 can be removed from the tube sheet simply by untightening the clamping fingers 3, 4 and by releasing the connecting means 30*b*. The device 21 is then anchored alone on the tube sheet, and it is now in its starting position for regular operation.

Once the task to be performed by the device 21 has been completed, the device 21 is removed by aid of the yoke 1, in a manner analogous to the manner in which it was installed. It should be stressed that the installation and removal process can be performed in a few minutes from outside the manhole 14 by only one person.

The foregoing is a description corresponding in substance to German Application G 87 12 638.9, dated Sept. 18, 1987, the International priority of which is being claimed for the instant application, and which is hereby made part of this application.

We claim:

1. Apparatus for introducing and/or positioning a device in a chamber of a heat exchanger, comprising an assembly yoke with ends and a middle to be manually introduced into the chamber of the heat exchanger, at least three remotely-actuatable clamping fingers disposed on said assembly yoke, means for locking said clamping fingers in tubes of the heat exchanger, a lifting cylinder holding one of said clamping fingers at least approximately at said middle of said yoke, remotely-actuatable clamping devices each releasably holding at least one of said clamping fingers on a respective one of said ends of said yoke, toothed belts each having an end connected to a respective one of said clamping fingers on said ends of said yoke, two synchronously controllable elevators each having a toothed belt drive in engagement with a respective one of said toothed belts, and support elements and releasable connecting means for the device being disposed on said synchronously controllable elevators.

2. Apparatus according to claim 1, wherein the device is a manipulator.

3. Apparatus according to claim 1, including a terminal contact disposed on said yoke forming means for triggering an automatic bracing of at least one of said clamping fingers after said at least one clamping finger has been introduced into a heat exchanger tube.

4. Apparatus according to claim 1, including a terminal contact disposed on at least one of said clamping fingers forming means for triggering an automatic bracing of said at least one clamping finger after said at least one clamping finger has been introduced into a heat exchanger tube.

5. Apparatus according to claim 1, wherein said lifting cylinder is rotatably supported on said yoke with said clamping finger at said middle of said yoke.

6. Apparatus according to claim 5, including a piston rod of said lifting cylinder, gearing means connected to said piston rod, and a remote-controllable electric drive motor connected to said gearing means.

7. Apparatus according to claim 1, further including a pole which has an end with a remotely-actuatable gripper device.

8. Apparatus according to claim 7, wherein said remotely-actuatable gripper device is actuatable by means of pressure fluid.

9. Apparatus according to claim 1, wherein said device has additional clamping fingers having mutual distances in correspondence with the mutual distances of the tubes of said heat exchanger.

10. Method for introducing and/or positioning a device in a chamber of a heat exchanger having a manhole, comprising the steps of (a) introducing an assembly yoke through said manhole into said chamber of said heat exchanger, said assembly yoke having a central clamping finger which is centrally disposed thereon and having at least two outer clamping fingers which are releasably disposed on respective ends thereof, said outer clamping fingers having connected thereto respective toothed belts;

(b) introducing said central clamping finger into a selected tube of said heat exchanger and locking said central clamping finger in said selected tube under remote control;

(c) rotating said assembly yoke about said central clamping finger, thereby adjusting a desired position with respect to the tube plate of said heat exchanger;

(d) moving said assembly yoke toward said tube plate of said heat exchanger, thereby introducing said outer clamping fingers into respective chosen tubes of said heat exchanger, and locking said outer clamping fingers in said respective chosen tubes under remote control;

(e) releasing said releasingly disposed outer clamping fingers from said assembly yoke, said outer clamping fingers still remaining in said chosen tubes, unlocking said central clamping finger in said selected tube, and subsequently removing said assembly yoke from said tube plate; and (f) moving said device along said threaded belts into said chamber.

11. Method according to claim 10, wherein said device has additional clamping fingers, further comprising the steps of subsequently introducing said additional clamping fingers into tubes of said heat exchanger and of locking said additional fingers therein under remote control.

12. Method according to claim 11, further comprising the steps of releasing said outer clamping fingers and of moving said outer clamping fingers and said threated belts away from said tube plate.

13. Method according to claim 12, further comprising the step of operating said device in its regular operation mode.

14. Method according to claim 13, further comprising the step of removing said device from said chamber by aid of said assembly yoke.

* * * * *